US011134552B1

(12) United States Patent
Wu et al.

(10) Patent No.: US 11,134,552 B1
(45) Date of Patent: Sep. 28, 2021

(54) RGB DECORATIVE LIGHTING HAVING SYNCHRONOUS LUMINESCENCE

(71) Applicant: ZHANGZHOU GO WIN LIGHTING CO., LTD, Zhangzhou (CN)

(72) Inventors: Qingan Wu, Zhangzhou (CN); Yao Liu, Zhangzhou (CN); Kai Wang, Zhangzhou (CN)

(73) Assignee: ZHANGZHOU GO WIN LIGHTING CO., LTD, Zhangzhou (CN)

( * ) Notice: Subject to any disclaimer, the term of this patent is extended or adjusted under 35 U.S.C. 154(b) by 0 days.

(21) Appl. No.: 17/060,048

(22) Filed: Sep. 30, 2020

(30) Foreign Application Priority Data

May 27, 2020 (CN) ..... 202020926159.7

(51) Int. Cl.
*H05B 47/155* (2020.01)
*H05B 45/37* (2020.01)
*H05B 45/20* (2020.01)

(52) U.S. Cl.
CPC ..... *H05B 47/155* (2020.01); *H05B 45/20* (2020.01); *H05B 45/37* (2020.01)

(58) Field of Classification Search
None
See application file for complete search history.

(56) References Cited

U.S. PATENT DOCUMENTS

2005/0116667 A1* 6/2005 Mueller ..... G09F 19/22 315/312
2008/0136334 A1* 6/2008 Robinson ..... H05B 47/18 315/151
2015/0237700 A1* 8/2015 Woytowitz ..... H05B 45/28 315/307
2015/0341994 A1* 11/2015 Wang ..... H05B 45/20 315/185 R
2019/0313503 A1* 10/2019 Woytowitz ..... H05B 47/19

* cited by examiner

*Primary Examiner* — Crystal L Hammond

(57) ABSTRACT

An RGB decorative lighting having synchronous luminescence, comprising power cable, the power cable is connected with a plurality of luminous devices in parallel, the luminous devices all comprise a power conversion unit, a control unit and a light unit; the power conversion unit is connected to the power cable in parallel, the control unit comprises a light control module and a signal synchronization module, the light control module is electrically connected to an output end of the rectifier circuit; the signal synchronization module is used to count a number of alternating current cycles to provide a synchronization signal; the light unit is electrically connected to the output end of the rectifier circuit, and the light unit is communicatively connected to the light control module.

6 Claims, 2 Drawing Sheets

RGB DECORATIVE LIGHTING HAVING SYNCHRONOUS LUMINESCENCE

CROSS REFERENCE TO RELATED APPLICATIONS

This application claims all benefits accruing under 35 U.S.C. § 119 from China Patent Application No. 202020926159.7 filed on May 27, 2020, in the State Intellectual Property Office of China, the disclosure of which is incorporated herein by reference in its entirety.

TECHNICAL FIELD

The disclosure generally relates to the field of decorative lighting, and more particularly to an RGB decorative lighting having synchronous luminescence.

BACKGROUND

Decorative lighting is a luminous device used as a decoration, which can be used to dress up indoors, public places, Christmas trees, etc., to decorate things with different lights. The decorative lighting is composed of multiple light units with multiple colors. For lighting control, such as light-dark, marquee effects, etc., traditional decorative lighting is controlled by the control unit.

Traditional decorative lighting needs to calculate the power according to the number of light units and match a power transformer to convert the mains power to supply for the light units. For lighting with different numbers of light units, different power transformers need to be designed and matched. At the same time, every light unit is controlled by a control unit, due to the slight difference in the chip pulse period of the control unit, after a period of lighting, the timing of each control unit has a large deviation, and the light unit appears to be irregular.

The purpose of this disclosure is to design an RGB decorative lighting having synchronous luminescence for the above existing technical problems.

SUMMARY OF DISCLOSURE

In view of the problems existing in the prior art, the disclosure provides an RGB decorative lighting having synchronous luminescence, and can effectively solve the problems existing in the prior art.

The technical scheme of the disclosure is:

An RGB decorative lighting having synchronous luminescence, comprises a power cable, wherein the power cable is connected with a plurality of luminous devices in parallel, the luminous devices all comprise a power conversion unit, a control unit, and a light unit; the power conversion unit is connected to the power cable in parallel, the power conversion unit comprises a step-down circuit and a rectifier circuit, the rectifier circuit is connected to an output end of the step-down circuit;

the control unit comprises a light control module and a signal synchronization module, the light control module is electrically connected to an output end of the rectifier circuit; the signal synchronization module is used to count a number of alternating current cycles to provide a synchronization signal; and the light unit is electrically connected to the output end of the rectifier circuit, and the light unit is communicatively connected to the light control module.

Further, wherein the light unit includes light sources with RGB three primary colors.

Further, wherein the step-down circuit is one of an RC step-down circuit, a resistance step-down circuit, a switching power supply step-down circuit, and a linear step-down circuit.

Further, wherein the rectifier circuit is a full bridge rectifier circuit.

Further, wherein the signal synchronization module is electrically connected to the light control module and the power cable.

Further, the signal synchronization module is electrically connected to the light control module and the output end of the step-down circuit.

The technical scheme has the following technical effects:

1) The control unit counts the pulses from the power cable or an output end of the step-down circuit through the signal synchronization module, and then controls the light unit to make corresponding changes. Because the power pulse period is under the same power cable, the pulse counts obtained by all luminous devices are the same as each one. All luminous devices can achieve synchronous or asynchronous changes with a timing by pulse counting from the signal synchronization module. So, all the luminous devices achieve effects of synchronized flashing, brightness change, color change, water flow, horse racing, etc.

2) In this present invention, a plurality of luminous devices are connected to the power cable in parallel, and the luminous devices all include a power conversion unit, a control unit, and a light-emitting unit, and there is no need to connect a transformer and a synchronization controller between the mains and the light sources.

DETAILED DESCRIPTION

To facilitate the understanding of those skilled in the art, the structure of the disclosure is further described in detail in connection with the accompanying drawings:

One embodiment of the disclosure,

Embodiment 1

Figure 1:
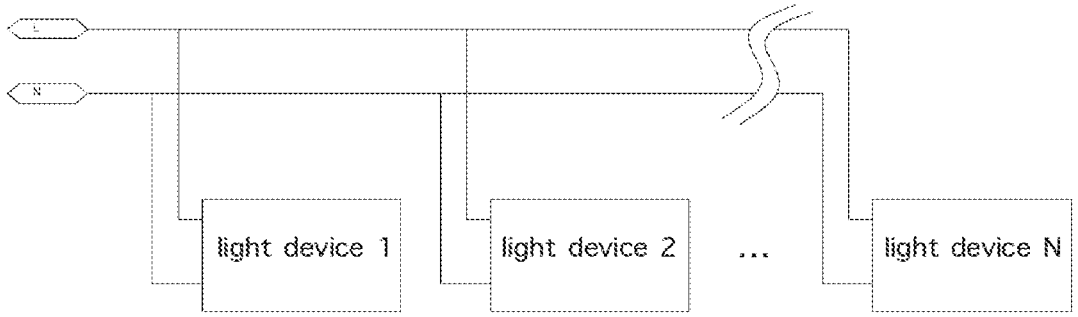
FIG. 1 is a function diagram of embodiment 1.
Figure 2:
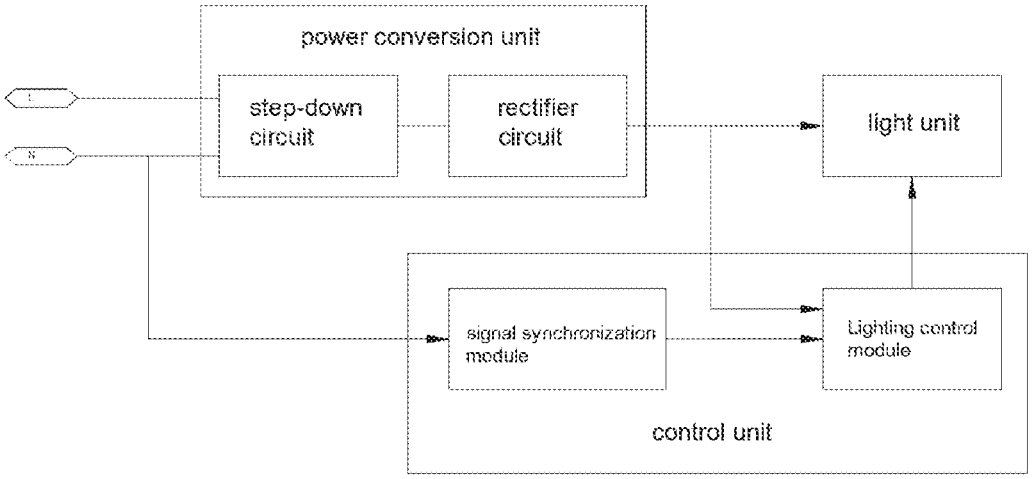
FIG. 2 is a function diagram of luminous devices of the embodiment 1.
Figure 3:
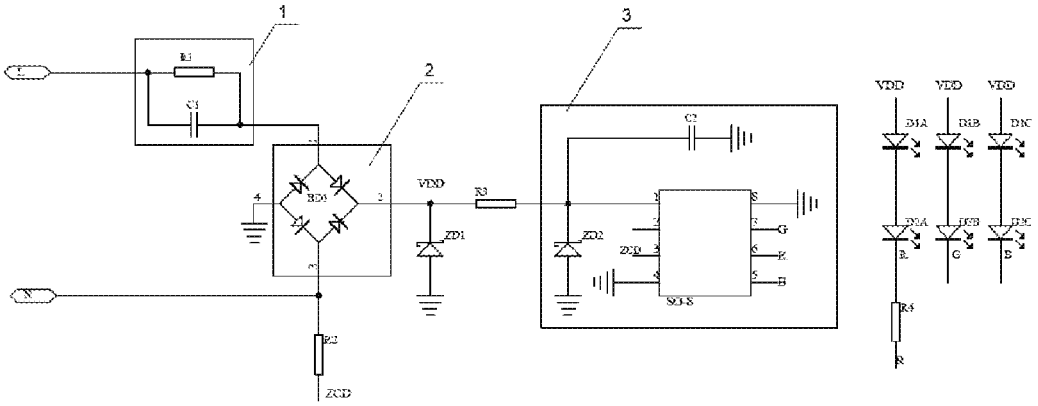
FIG. 3 is a circuit diagram of the power conversion unit and the control unit of the embodiment 1.

One embodiment of the disclosure, referring to FIG. 1-3.

An RGB decorative lighting having synchronous luminescence, comprising a power cable, wherein the power cable is connected with a plurality of luminous devices in parallel, the luminous devices all comprise a power conversion unit, a control unit, and a light unit; the power conversion unit is connected to the power cable in parallel, the power conversion unit comprises a step-down circuit and a rectifier circuit, the rectifier circuit is connected to an output end of the step-down circuit;

the control unit comprises a light control module and a signal synchronization module, the light control module is electrically connected to an output end of the rectifier circuit; the signal synchronization module is used to count a number of alternating current cycles to provide a synchronization signal, and the light unit is electrically connected to the output end of the rectifier circuit, and the light unit is communicatively connected to the light control module.

Specifically, the light unit includes light sources with RGB three primary colors. In this embodiment, the light source is a threaded bulb.

Specifically, the step-down circuit is one of an RC step-down circuit, a resistance step-down circuit, a switching power supply step-down circuit, and a linear step-down circuit. In this embodiment, the step-down circuit is RC step-down circuit.

Specifically, the rectifier circuit is a full bridge rectifier circuit.

Specifically, the signal synchronization module is electrically connected to the light control module and the power cable.

This embodiment is implemented based on the circuit diagram shown in FIG. 3. First of all, the mains is stepped down by the RC step-down circuit 1 and rectified by the rectifier circuit 2.

The rectifier circuit 2 supplies power to the control unit U1 and the light unit. The control unit U1 used in this embodiment is composed of a microcontroller and its peripheral circuits, pin 5, pin 6, and pin 7 of the microcontroller are respectively connected to the corresponding RGB pins of the light unit, pin 1 of the microcontroller is connected to an output end of the rectifier circuit through a pull-up resistor, and pin 3 of the microcontroller is connected to the power cable through a step-down resistor R3.

When working, the control unit counts the pulses from the power cable through the signal synchronization module, and then controls the light unit to make corresponding changes. Because the power pulse period is under the same power cable, the pulse counts obtained by all luminous devices are the same as each one. All luminous devices can achieve synchronous or asynchronous changes with a timing by pulse counting from the signal synchronization module. So, all the luminous devices achieve effects of synchronized flashing, brightness change, color change, water flow, horse racing, etc.

Embodiment 2

Figure 4:
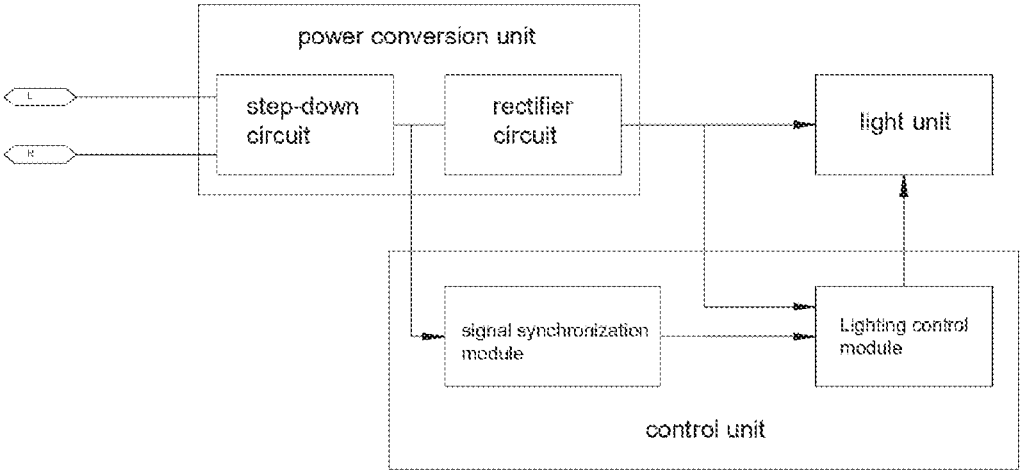
FIG. 4 is a function diagram of luminous devices of embodiment 2.

One embodiment of the disclosure, referring to FIG. 4.

This embodiment is basically the same as the embodiment 1, the difference is that the signal synchronization module is electrically connected to the light control module and the output end of the step-down circuit. The signal synchronization module is used to count the number of alternating current cycle changes of the step-down mains and provide a synchronization signal.

A working principle of this embodiment is the same as that of the embodiment 1 and will not be described here.

The foregoing description is only a preferred embodiment of the disclosure, and all changes and modifications to the patent scope applied for in accordance with the disclosure shall belong to the scope covered by the disclosure.

What is claimed is:

1. An RGB decorative lighting having synchronous luminescence, comprising a power cable, wherein the power cable is connected with a plurality of luminous devices in parallel, the luminous devices all comprise a power conversion unit, a control unit, and a light unit;

the power conversion unit is connected to the power cable in parallel, the power conversion unit comprises a step-down circuit and a rectifier circuit, the rectifier circuit is connected to an output end of the step-down circuit;

the control unit comprises a light control module and a signal synchronization module, the light control module is electrically connected to an output end of the rectifier circuit; the signal synchronization module is used to count a number of alternating current cycles to provide a synchronization signal; and the light unit is electrically connected to the output end of the rectifier circuit, and the light unit is communicatively connected to the light control module.

2. The RGB decorative lighting having synchronous luminescence according to claim 1, wherein the light unit comprises light sources with RGB three primary colors.

3. The RGB decorative lighting having synchronous luminescence according to claim 1, wherein the step-down circuit is one of an RC step-down circuit, a resistance step-down circuit, a switching power supply step-down circuit, and a linear step-down circuit.

4. The RGB decorative lighting having synchronous luminescence according to claim 1, wherein the rectifier circuit is a full bridge rectifier circuit.

5. The RGB decorative lighting having synchronous luminescence according to claim 1, wherein the signal synchronization module is electrically connected to the light control module and the power cable.

6. The RGB decorative lighting having synchronous luminescence according to claim 1, wherein the signal synchronization module is electrically connected to the light control module and the output end of the step-down circuit.

* * * * *